US010590366B2

(12) United States Patent
Peera et al.

(10) Patent No.: US 10,590,366 B2
(45) Date of Patent: Mar. 17, 2020

(54) OPACIFIERS FOR DETERGENT COMPOSITIONS

(71) Applicants: Dow Global Technologies LLC, Midland, MI (US); Rohm and Haas Company, Collegeville, PA (US)

(72) Inventors: Asghar A. Peera, Royersford, PA (US); Anne Oberlin, Antibes (FR); Afua Sarpong Karikari, Bristol, PA (US)

(73) Assignees: Dow Global Technologies LLC, Midland, MI (US); Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 15/754,669

(22) PCT Filed: Nov. 14, 2016

(86) PCT No.: PCT/US2016/061744

§ 371 (c)(1),
(2) Date: Feb. 23, 2018

(87) PCT Pub. No.: WO2017/099943

PCT Pub. Date: Jun. 15, 2017

(65) Prior Publication Data

US 2018/0265810 A1 Sep. 20, 2018

(30) Foreign Application Priority Data

Dec. 10, 2015 (EP) ..... 15290307

(51) Int. Cl.

| | |
|---|---|
| ***C11D 1/00*** | (2006.01) |
| ***C11D 3/37*** | (2006.01) |
| ***C11D 3/43*** | (2006.01) |
| ***C11D 3/00*** | (2006.01) |
| ***C11D 17/00*** | (2006.01) |
| ***C11D 17/04*** | (2006.01) |

(52) U.S. Cl.
CPC ..... *C11D 3/0089* (2013.01); *C11D 3/3765* (2013.01); *C11D 17/0013* (2013.01); *C11D 17/043* (2013.01)

(58) Field of Classification Search
CPC ..... C11D 1/00; C11D 3/37; C11D 3/3746; C11D 3/43; C11D 17/042
See application file for complete search history.

(56) References Cited

U.S. PATENT DOCUMENTS

| | | | | |
|---|---|---|---|---|
| 4,880,842 | A | 11/1989 | Kowalski et al. | |
| 5,157,084 | A | 10/1992 | Lee et al. | |
| 6,020,435 | A * | 2/2000 | Blankenship | C08F 265/04 525/256 |
| 8,835,372 | B2 | 9/2014 | Jennewein | |
| 2005/0059748 | A1 | 3/2005 | Blankenship | |
| 2008/0081175 | A1 | 4/2008 | Mukkamala | |
| 2008/0248986 | A1 | 10/2008 | Gray et al. | |
| 2010/0048750 | A1 | 2/2010 | Blom et al. | |
| 2010/0305020 | A1 * | 12/2010 | Jennewein | C11D 3/0084 510/513 |
| 2015/0247108 | A1 | 9/2015 | Bettiol et al. | |

FOREIGN PATENT DOCUMENTS

| | | |
|---|---|---|
| WO | 2002060758 | 8/2002 |

OTHER PUBLICATIONS

Nuasaen, Optical Properties of Hollow Latex Particles as White Pigment in Paint Film, Progress in Organic Coatings, 2015, pp. 83-89, vol. 79.

* cited by examiner

*Primary Examiner* — Brian P Mruk
(74) *Attorney, Agent, or Firm* — Raef Shaltout

(57) ABSTRACT

Provided is a detergent composition that contains an opacifier with improved opacifying characteristics. The composition comprises an opacifier, a surfactant, a solvent, and optionally a builder, wherein the opacifier is an aqueous dispersion of voided latex particles have a composition as described herein.

9 Claims, No Drawings

OPACIFIERS FOR DETERGENT COMPOSITIONS

FIELD

This invention relates generally to detergent compositions containing improved opacifiers.

BACKGROUND

Liquid laundry and dishwashing detergents play an essential role in the lives of consumers. Detergents are available in a variety of forms, such as the conventional detergents that are typically measured out by the consumer immediately before use (including those in concentrated form), as well the more recent unit dose detergent packets, where a pre-measured quantity of the detergent is encased in a water soluble film. Unit dose detergent packets generally contain less water than the other forms. This is driven by the fact that the typical water soluble films used for encasing the detergent, such as partially hydrolyzed polyvinyl alcohol homopolymers (PVOH), are sensitive to the presence of water, and can tolerate only a limited amount before premature dissolution.

In addition to cleaning performance, the aesthetic look and feel of a detergent is an important consideration for consumers. Thus, detergents typically contain a variety of ingredients that impact functionality, aesthetics, or both, including, for instance, surfactants, solvents, optional builder, and opacifiers.

Opacifiers are materials that make a liquid system opaque. Thus, opacifiers are used to modify the appearance or aesthetics of detergents, for instance, by transforming the liquid from clear or translucent to opaque. Opacifiers can provide a uniform, luxurious, "lotionized" appearance to a liquid product. Opacifiers are usually formed of submicron sized particles that are delivered to a formulation as a suspension of the particles in a solvent (typically water).

Since opacifiers are targeted to a formulation's aesthetics, it is generally desirable that their inclusion not interfere with the function of the formulation or otherwise negatively impact the formulation. For instance, opacifiers that exhibit limited compatibility with other materials in the formulation, have issues with stability, exhibit spotting or residue formation, are not favored. In addition, opacifiers that introduce large amounts of water into a formulation, e.g., by being effective only when used in large quantities, are also not favored, particularly for those formulations where limiting the quantity of water is desired, such as in concentrated detergents or unit dose packets.

It would be an advance in the art to develop new detergent composition opacifiers that exhibit improved properties over known materials, such as formulation stability and efficient opacifying characteristics at low use levels.

STATEMENT OF INVENTION

We have now found that aqueous dispersions of voided latex particles, as described herein, are effective opacifiers for use in liquid detergent compositions. Advantageously, the opacifiers are highly efficient, compared to commercially known opacifiers, thus permitting lower use levels. For instance, in some embodiments, it may be possible to reduce the amount of opacifier, and still achieve desirable opacifying properties, by 50 percent or more, relative to known opacifiers. In addition, the opacifiers of the invention yield stable formulations in a variety of solvents that are commonly used in detergents, such as propylene glycol, and dipropylene glycol. As a consequence of their favorable properties, the opacifiers of the inventions are highly attractive for use in all types of detergents, including unit dose detergent packets.

Accordingly, in one aspect, the invention provides a detergent composition. The composition comprises: an opacifier, a surfactant, a solvent, and optionally a builder, wherein the opacifier is an aqueous dispersion of voided latex particles comprising:

(i) at least one core polymer comprising polymerized units derived from (a) 20 to 60 weight % of monoethylenically unsaturated monomers containing at least one carboxylic acid group, based on the total weight of the core polymer(s), and (b) 40 to 80 weight % of non-ionic ethylenically unsaturated monomers, based on the total weight of the core polymer(s); and (ii) at least one shell polymer comprising polymerized units derived from (a) 55 to 85 weight % of non-ionic ethylenically unsaturated monomers, based on the total weight of the shell polymer(s), and (b) 15 to 45 weight % of polyethylenically unsaturated monomers, based on the total weight of the shell polymer(s), wherein the voided latex particles contain a void and have a particle size of from 50 nm to 1000 nm.

In another aspect, the invention provides a detergent packet comprising a detergent composition as described herein, encased in a water soluble pouch or film.

In a further aspect, the invention concerns a method for providing opacity to a detergent composition containing a surfactant, a solvent, and optionally a builder. The method comprises including in the detergent composition an aqueous dispersion of voided latex particles as described herein.

DETAILED DESCRIPTION

Unless otherwise indicated, numeric ranges, for instance as in "from 2 to 10," are inclusive of the numbers defining the range (e.g., 2 and 10). Unless otherwise indicated, ratios, percentages, parts, and the like are by weight. As used herein, unless otherwise indicated, the phrase "molecular weight" or Mw refers to the weight average molecular weight as measured in a conventional manner with gel permeation chromatography (GPC) and polyacrylic acid standards. GPC techniques are discussed in detail in Modem Size Exclusion Chromatography, W. W. Yau, J. J. Kirkland, D. D. Bly; Wiley-Interscience, 1979, and in A Guide to Materials Characterization and Chemical Analysis, J. P. Sibilia; VCH, 1988, p. 81-84. Molecular weights are reported herein in units of Daltons. The term "ethylenically unsaturated" is used to describe a molecule or moiety having one or more carbon-carbon double bonds, which renders it polymerizable. "Polymer" refers to a polymeric compound prepared by polymerizing monomers, whether of the same or a different type. The generic term "polymer" includes the terms "homopolymer," "copolymer," and "terpolymer." The term "polymerized units derived from" refers to polymer molecules that are synthesized according to polymerization techniques wherein a product polymer contains "polymerized units derived from" the constituent monomers which are the starting materials for the polymerization reactions. The term "ethylenically unsaturated" includes monoethylenically unsaturated (having one carbon-carbon double bond) and multi-ethylenically unsaturated (having two or more carbon-carbon double bonds). As used herein the term "(meth)acrylic" refers to acrylic or methacrylic and "(meth) acrylate" refers to either acrylate or methacrylate. Weight percentages (or weight % or wt %) in the composition are percentages of dry or actives weight, i.e., excluding any water that may be present in the composition. Percentages of monomer units in the polymer are percentages of solids or neat monomer weight, i.e., excluding any water present in a polymer emulsion, and are based on the total weight of the polymer (determined from the total weight of the monomers from which the polymer is comprised). "Detergent composition" refers to liquid laundry or dishwashing detergents for manual use or for use in an automatic dish or laundry washing machine. The term encompasses aqueous, concentrated, heavy duty, light duty, and unit dose type detergents.

As indicated above, the invention provides a detergent composition comprising: an opacifier, a surfactant, a solvent, and optionally a builder. The opacifier of the invention is an aqueous dispersion of voided latex particles containing at least one core polymer and at least one shell polymer, and wherein the voided latex particles contain a void and have a particle size of from 50 nm to 1000 nm.

The voided latex particles of the invention are multi-stage polymers that include a core stage polymer (the "core"), and a shell stage polymer (the "shell"). The core and shell may themselves be comprised of more than one stage. There may also be one or more intermediate stages. Preferably, the multi-stage polymer comprises a core, an intermediate layer and a shell.

The cores of the multi-stage polymers of the present invention are emulsion polymers comprising, as polymerized units, from 5 to 100 percent by weight, based on the weight of the core, of at least one hydrophilic monoethylenically unsaturated monomer and from 0 to 95 percent by weight, based on the weight of the core stage polymer, of at least one nonionic monoethylenically unsaturated monomer.

Cores containing at least five percent by weight, based on the total weight of the core polymer, of at least one hydrophilic monoethylenically unsaturated monomer will generally result in a suitable degree of swelling. There may be instances where, because of the hydrophobicity of certain comonomers or combinations thereof in conjunction with the hydrophobic/hydrophilic balance of a particular hydrophilic monomer, the copolymer may be suitably prepared with less than five percent by weight, based on the total weight of the core polymer, of a hydrophilic monoethylenically unsaturated monomer. Preferably, the core comprises, as polymerized units, hydrophilic monoethylenically unsaturated monomer at a level of from 5 to 100, more preferably, from 20 to 60, and most preferably, from 30 to 50 percent by weight based on the total weight of the core. The hydrophilic core polymer may be made in a single stage or step of the sequential polymerization or may be made by a plurality of steps in sequence.

The multi-stage emulsion polymer of the present invention contemplates a core polymer wherein at least one hydrophilic monoethylenically unsaturated monomer is polymerized alone or with at least one nonionic monoethylenically unsaturated monomer. This process also contemplates, and includes in the term "hydrophilic monoethylenically unsaturated monomer," the use of a nonpolymeric compound containing at least one carboxylic acid group which absorbed into the core polymer before, during or after the polymerization of the hydrophobic shell polymer as a replacement for the hydrophilic monoethylenically unsaturated monomer in the hydrophilic core polymer, as described in U.S. Pat. No. 4,880,842. In addition, this invention contemplates, and includes in the term "hydrophilic monoethylenically unsaturated monomer," the use of a latent hydrophilic core polymer which contains no hydrophilic monoethylenic ally unsaturated monomer but which is swellable upon hydrolysis to a hydrophilic core polymer as described in U.S. Pat. No. 5,157,084.

Suitable hydrophilic monoethylenically unsaturated monomer useful for making the core polymer include monoethylenically unsaturated monomers containing acid-functionality such as monomers containing at least one carboxylic acid group including acrylic acid, methacrylic acid, acryloxypropionic acid, (meth)acryloxypropionic acid, itaconic acid, aconitic acid, maleic acid or anhydride, fumaric acid, crotonic acid, monomethyl maleate, monomethyl fumarate, monomethyl itaconate and the like. Acrylic acid and methacrylic acid are preferred. Methacrylic acid is more preferred.

Suitable nonpolymeric compounds containing at least one carboxylic acid group include C6-C12 aliphatic or aromatic monocarboxylic acids and dicarboxylic acids, such as benzoic acid, m-toluic acid, p-chlorobenzoic acid, o-acetoxybenzoic acid, azelaic acid, sebacic acid, octanoic acid, cyclohexanecarboxylic acid, lauric acid and monobutyl phthalate and the like.

Suitable nonionic monoethylenically unsaturated monomers for making the hydrophilic core polymer include styrene, α-methyl styrene, p-methyl styrene, t-butyl styrene, vinyltoluene, ethylene, vinyl acetate, vinyl chloride, vinylidene chloride, (meth)acrylonitrile, (meth)acrylamide, (C1-C20) alkyl or (C3-C20) alkenyl esters of (meth)acrylic acid, such as methyl (meth)acrylate, ethyl (meth)acrylate, butyl (meth)acrylate, 2-ethylhexyl (meth)acrylate, hydroxyethyl(meth)acrylate, hydroxypropyl(meth)acrylate, benzyl (meth)acrylate, lauryl (meth)acrylate, oleyl (meth)acrylate, palmityl (meth)acrylate, stearyl (meth)acrylate and the like. Methyl methacrylate is preferred.

The core, whether obtained by a single stage process or a process involving several stages, has an average particle size of from 50 nm to 1.0 micron, preferably from 100 nm to 300 nm, diameter in unswollen condition. If the core is obtained from a seed polymer, the seed polymer preferably has an average particle size of from 30 nm to 200 nm.

The core may also optionally contain less than 20 percent by weight, preferably from 0.1 to 3 percent by weight, based on the total weight of the core, of polyethylenically unsaturated monomer, wherein the amount used is generally approximately directly proportional to the amount of hydrophilic monoethylenically unsaturated monomer used; in other words, as the relative amount of hydrophilic monomer increases, it is acceptable to increase the level of polyethylenically unsaturated monomer. Alternatively, the core polymer may contain from 0.1 to 60 percent by weight, based on the total weight of the core polymer, of butadiene.

Suitable polyethylenically unsaturated monomers include comonomers containing at least two addition polymerizable vinylidene groups and are alpha beta ethylenically unsaturated monocarboxylic acid esters of polyhydric alcohols containing 2-6 ester groups. Such comonomers include alkylene glycol diacrylates and dimethacrylates, such as for example, ethylene glycol diacrylate, ethylene glycol dimethacrylate, 1,3-butylene glycol diacrylate, 1,4-butylene glycol diacrylate propylene glycol diacrylate and triethylene glycol dimethylacrylate; 1,3-glycerol dimethacrylate; 1,1,1-trimethylol propane dimethacrylate; 1,1,1-trimethylol ethane diacrylate; pentaerythritol trimethacrylate; 1,2,6-hexane triacrylate; sorbitol pentamethacrylate; methylene bis-acrylamide, methylene bis-methacrylamide, divinyl benzene, vinyl methacrylate, vinyl crotonate, vinyl acrylate, vinyl acetylene, trivinyl benzene, triallyl cyanurate, divinyl acetylene, divinyl ethane, divinyl sulfide, divinyl ether, divinyl sulfone, diallyl cyanamide, ethylene glycol divinyl ether, diallyl phthalate, divinyl dimethyl silane, glycerol trivinyl ether, divinyl adipate; dicyclopentenyl (meth)acrylates; dicyclopentenyloxy (meth)acrylates; unsaturated esters of glycol monodicyclopentenyl ethers; allyl esters of α,β-unsaturated mono- and dicarboxylic acids having terminal ethylenic unsaturation including allyl methacrylate, allyl acrylate, diallyl maleate, diallyl fumarate, diallyl itaconate and the like.

The multi-stage polymer of the present invention preferably contains an intermediate stage. The intermediate stage polymer, when present, partially or fully encapsulates the core and itself is partially or fully encapsulated by the shell. The intermediate stage is prepared by conducting an emulsion polymerization in the presence of the core.

The intermediate stage preferably contains, as polymerized units, from 0.3 to 20, more preferably from 0.5 to 10 percent by weight, based on the weight of the intermediate stage polymer, of at least one hydrophilic monoethylenically unsaturated monomer. The intermediate stage preferably contains, as polymerized units, from 80 to 99.7, more preferably from 90 to 99.5 percent by weight, based on the weight of the intermediate stage polymer, of at least one nonionic monoethylenically unsaturated monomer. The hydrophilic monoethylenically unsaturated monomers and the nonionic monoethylenically unsaturated monomers useful for making the core are also useful for making the intermediate layer.

The shell of the multi-staged polymer of this invention is the product of emulsion polymerizing from 50 to 100, preferably from 80 to 100, more preferably from 90 to 100, percent by weight, based on the total weight of the shell, of at least one nonionic monoethylenically unsaturated monomer. The nonionic monoethylenically unsaturated monomers suitable for the core are also suitable for the shell. Styrene is preferred.

The shell(s) may also contain, as polymerized units, from 0 to 20, preferably from 0 to 10, percent by weight based on the weight of the shell, of one or more monoethylenically unsaturated monomers containing acid-functionality. Suitable monoethylenically unsaturated monomers containing acid-functionality include acrylic acid, methacrylic acid, acryloxypropionic acid, (meth)acryloxypropionic acid, itaconic acid, aconitic acid, maleic acid, maleic anhydride, fumaric acid, crotonic acid, monomethyl maleate, monomethyl fumarate, monomethyl itaconate and the like. Acrylic acid and methacrylic acid are preferred.

The monomers used and the relative proportions thereof in the shell should be such that it is permeable to an aqueous or gaseous volatile or fixed basic swelling agent capable of swelling the core. Monomeric mixtures for making the shell preferably contain from about 0.1% by weight to about 10% by weight, based on the total weight of the shell polymer, of an acid-functional monoethylenically unsaturated monomer. Preferably, the proportion of acid-functional monoethylenically unsaturated monomer in the shell polymer does not exceed one-third the proportion thereof in the core polymer.

Voided latex particles as described above can be prepared by any of several known process, including those described in U.S. Pat. No. 6,020,435, which is incorporated herein by reference in its entirety. In certain embodiments, the void of the latex particles is prepared by swelling the core with a swelling agent containing one or more volatile components. The swelling agent permeates the shell to swell the core. The volatile components of the swelling agent can then be removed by drying the latex particles, causing a void to be formed within the latex particles. In certain embodiments, the swelling agent is an aqueous base. Suitable aqueous bases useful for swelling the core include, for example, ammonia, ammonium hydroxide, alkali metal hydroxides, such as sodium hydroxide, or a volatile amine such as trimethylamine or triethylamine. In certain embodiments, the voided latex particles are added to the composition with the swelling agent present in the core. When the latex particles are added to the composition with the swelling agent present in the core, the volatile components of the swelling agent will be removed upon drying of the composition. In certain other embodiments, the voided latex particles are added to the composition after removing the volatile components of the swelling agent.

In certain embodiments, the voided latex particles contain a void with a void fraction of from 1% to 70%, preferably from 5% to 50%, more preferably from 25% to 50%, and even more preferably from 35% to 45%. In some embodiments, the voided latex particles contain a void with a void fraction of at least 28%, alternatively at least 30%, alternatively at least 35%. In some embodiments, the voided latex particles contain a void with a void fraction up to 50%. The void fractions are determined by comparing the volume occupied by the latex particles after they have been compacted from a dilute dispersion in a centrifuge to the volume of non-voided particles of the same composition. In certain embodiments, the voided latex particles have a particle size of from 50 nm to 1000 nm, preferably 200 nm to 800 nm, preferably 400 nm to 800 nm, preferably from 400 nm to 700 nm, more preferably from 400 nm to 600 nm, and even more preferably from 400 nm to 550 nm, as measured by a Brookhaven BI-90. In some embodiments, the voided latex particles have a particle size of from 200 nm to 500 nm.

The voided latex particles are employed in the inventive compositions in the form of an aqueous dispersion. Preferably, the dispersion contains from 10 to 80 solids weight %, more preferably from 20 to 50 solids weight % of the voided latex particles, based on the total weight of the aqueous dispersion.

A person of ordinary skill in the art can readily determine the effective amount of the voided latex particles that should be used in a particular composition in order to provide the benefits described herein, via a combination of general knowledge of the applicable field as well as routine experimentation where needed. By way of non-limiting example, the amount of voided latex particles in the composition of the invention may be in the range of from 0.001 to 5 solids weight %, preferably from 0.02 to 1.5 solids weight %, based on the total weight of the detergent composition.

The surfactant(s) utilized in the compositions of the invention may be cationic, anionic, nonionic, fatty acid metal salt, zwitterionic or betaine surfactants. Preferably, when the detergent composition is a laundry detergent, the surfactant comprises at least one surfactant selected from anionic and nonionic surfactants, preferably at least two. Preferred surfactants when the detergent composition is a dishwashing composition are nonionic surfactants, more preferably low foam nonionic surfactants.

Preferably, nonionic surfactants have an alkyl group having at least eight carbon atoms and at least five polymerized ethylene oxide or propylene oxide residues. Preferably, nonionic surfactants have at least five polymerized ethylene oxide residues, preferably at least six, preferably at least seven, preferably at least eight; preferably no more than twelve, preferably no more than eleven, preferably no more than ten. Preferably, the nonionic surfactant is a linear alcohol ethoxylate. Preferably, a linear alcohol ethoxylate has a linear $C_6$-$C_{16}$ alkyl group, preferably $C_8$-$C_{14}$. Preferably the alkyl groups are mixtures derived from seed oil, preferably comprising 70% $C_8$-$C_{10}$ linear alkyl and 70% $C_{12}$-$C_{14}$ linear alkyl. Preferably, a linear alcohol ethoxylate contains from five to nine polymerized units of ethylene oxide, preferably seven. Preferably, a linear alcohol ethoxylate has two to four polymerized units of propylene oxide between the alkyl group and the ethylene oxide units, preferably three units of propylene oxide.

Preferably, anionic surfactants have an alkyl group having at least ten carbon atoms and an anionic group, preferably selected from sulfonates and carboxylates. Anionic surfactants also may have polymerized residues of ethylene oxide, and/or may have aromatic rings, e.g., linear alkylbenzene sulfonates. Some anionic surfactants are fatty acid alkali metal salts.

Suitable cationic surfactants include, for example, amine surfactants and quaternary ammonium salt surfactants. Suitable amine surfactants include, for example, primary, secondary, and tertiary alkyl amine surfactants; primary, secondary, and tertiary alkenyl amine surfactants; imidazoline surfactants; amine oxide surfactants; ethoxylated alkylamine surfactants; surfactants that are alkoxylates of ethylene diamine; and amine surfactants where the hydrophobic group contains at least one amide linkage. Suitable quaternary ammonium salt surfactants include, for example, dialkyldimethylammonium salt surfactants, alkylbenzyldimethylammonium salt surfactants, alkyltrimethylammonium salt surfactants, alkylpyridinium halide surfactants, surfactants made by quaternizing tertiary amine compounds, and esterquats (i.e., surfactants that are quaternary ammonium salts with at least one hydrophobic group that contains an ester linkage). Suitable quaternary ammonium salt surfactants have corresponding anions. Suitable corresponding anions include, for example, halide ions (such as, for example, chloride ions), methyl sulfate ions, other anions, and mixtures thereof.

A person of ordinary skill in the art can readily determine the amount of a surfactant that should be used in a particular detergent composition. For instance, by way of non-limiting example, the amount of surfactant for an automatic dishwashing detergent composition may be in the range of from 0.5 to 10 weight %, alternatively from 1 to 8 weight percent, based on the total weight of the detergent composition. In an aqueous laundry detergent composition, the amount of surfactant may, for instance, range from 5 to 80 weight %, alternatively 7 to 60 weight %, based on the total weight of the detergent composition. In a unit dose detergent packet, the amount of surfactant in the detergent may, for instance, range from 20 to 85 weight %, alternatively 30 to 70 weight %, based on the total weight of the detergent composition.

Solvents that may be used in the detergent compositions of the invention include, for instance, water, propylene glycol, dipropylene glycol, glycerol, ethanol, polypropylene glycol and polyethylene glycol, or mixtures thereof. Preferably, the solvent is water or is a water soluble material. The solvent generally comprises the balance of the detergent composition, to bring the composition to 100%, after the amounts of the other required and optional ingredients have been selected. By way of example, in some embodiments, the amount of solvent (separate from any solvents that is present by way of the voided latex particle dispersion) may range, for instance, from 0.1 to 95 weight %, alternatively from 0.2 to 70 weight percent, based on the total weight of the detergent composition. In some embodiments, the solvent comprises water and one or more water soluble co-solvents. Preferably, the amount of water ranges from 0.1 to 80 weight % and the amount of water soluble co-solvents ranges from 0.1 to 50 weight %, each based on the total weight of the water and the co-solvents. It should be understood that in the case of unit dose detergent packets, the amount of water added to the detergent composition may be 0% (i.e., no water is added). Nevertheless, such detergent composition will still contain water that is introduced by the other ingredients in the composition including, for instance, the opacifier dispersion.

When builders are present in the compositions of the invention, preferred builders include citrates, phosphates, carbonates, aluminosilicates, organic phosphonates, carboxylates, polycarboxylates (e.g., polyacrylic acid or maleic/(meth)acrylic acid copolymers), polyacetyl carboxylates, or mixtures thereof. The term "carbonate(s)" refers to carbonate, bicarbonate, percarbonate, and/or sesquicarbonate. Builders may be added as salts or in the acid form. In some embodiments, the carbonates or citrates are sodium, potassium or lithium salts; preferably sodium or potassium; preferably sodium. Preferred builders include sodium carbonate, sodium bicarbonate, sodium citrate, or mixtures of two or more thereof. In some embodiments, the amount of builder when present in the inventive compositions may range, for instance, from 0.1 to 50 weight %, alternatively from 0.5 to 40 weight percent, based on the total weight of the detergent composition.

Co-builders may also be included in the compositions of the invention. Preferred co-builders include, but are not limited to, polyacrylic acid and its copolymers, sulfonates, phosphonates (e.g., sodium diethylenetriamine pentamethylene phosphonate). In some embodiments, the amount of co-builders, when present in the inventive composition, may range, for instance, from 0.1 to 20 weight %, alternatively from 0.5 to 10 weight percent, based on the total weight of the detergent composition. Builders and co-builders are preferably present in detergent compositions that are automatic dishwashing detergents.

The detergent composition may also comprise various other optional ingredients including, without limitation, hydrotropes (e.g., ethanol, propylene glycol), enzymes (e.g., protease, lipase, amylase), preservatives, perfumes, fluorescent agents, shading dyes, additional builders, and/or additive polymers (e.g., anti-redeposition polymers, anti-greying polymers).

Preferably, the detergent composition has a pH from 6 to 11, preferably from 6.5 to 10, preferably 7 to 9, preferably from 7 to 8.5, preferably from 7 to 8. Suitable bases to adjust the pH of the formulation include mineral bases such as sodium hydroxide and potassium hydroxide; ammonium hydroxide; and organic bases such as mono-, di- or triethanolamine; or 2-dimethylamino-2-methyl-1-propanol (DMAMP). Mixtures of bases may be used. Suitable acids to adjust the pH of the aqueous medium include mineral acid such as hydrochloric acid, phosphorus acid, and sulfuric acid; and organic acids such as acetic acid. Mixtures of acids may be used. The formulation may be adjusted to a higher pH with base and then back titrated to the ranges described above with acid.

The composition can be formulated in any liquid form, e.g., as a monodose, sachet, paste, liquid or gel. Methods for forming the compositions into the desired form are well known in the art.

In some embodiments, the inventive composition is formed as a unit dose detergent package, where the detergent is encased in a water soluble pouch or film. Such packets may be used, for example, in laundry or in automatic dishwashing. Suitable materials for the water soluble pouch or film include, for instance, polyvinyl alcohol (PVOH).

Methods for forming pouches are known and are described, for example, in WO 2002/060758A1. Preferably, the solvent of the detergent composition, when used in a unit dose detergent packet, is non-aqueous, such as propylene glycol, glycerol, or mixtures thereof. The amount of the non-aqueous solvent may, for instance, be from 5 wt % to 20 wt %. The detergent formulation in the unit dose packet may contain water as a solvent, although typically the amount is less than 20 wt %, alternatively less than 15 wt %, and maybe at least 1 wt %, alternatively at least 4 wt %. The amount of detergent formulation in a unit dose packet may vary depending on the size of the package desired. The amount may, for instance, range from 3 g to 35 g.

In some embodiments, the inventive detergent composition is an aqueous laundry detergent, for instance a heavy duty laundry detergent or a light duty laundry detergent. Such compositions may contain up to 95 weight % water as a solvent, based on the total weight of the composition.

In some embodiments, the inventive composition is an automatic dishwashing composition. Automatic dishwashing composition may contain various optional ingredients, in addition to those recited above, for instance, one or more of: an alkaline source (e.g., alkali metal carbonates or alkali metal hydroxides), a bleaching agent (e.g., sodium percarbonate, sodium perborate) and optionally a bleach activator (e.g., tetraacetylethylenediamine (TAED)) and/or a bleach catalyst (e.g., manganese(II) acetate, or cobalt(II) chloride); and/or an aminocarboxylate compound (e.g., MGDA). In some embodiments, the composition is an automatic dishwashing composition that is phosphate free. The term "phosphorus-free" refers to compositions containing less than 0.5 wt % phosphorus (as elemental phosphorus), preferably less than 0.2 wt %, preferably less than 0.1 wt %, preferably no detectable phosphorus.

The detergent composition of the invention can be used under typical operating conditions. For instance, when used in an automatic dishwashing or laundry machine, the detergent may be added to the machine under the conditions recommended by the machine's manufacturer.

Some embodiments of the invention will now be described in detail in the following Examples.

EXAMPLES

Example 1

Preparation of Exemplary Voided Latex Particles

Exemplary voided latex particles for use in the compositions of the invention are commercially available and/or may be prepared, for example, as described in U.S. Pat. No. 6,020,435. An example of the synthesis of a voided latex particle is provided below.

A core is prepared as follows: A 5-liter, four necked round bottom flask is equipped with a paddle stirrer, thermometer, nitrogen inlet, and reflux condenser. Deionized water, 1760 grams, is added to the kettle and heated to 86° C. under a nitrogen atmosphere. A monomer emulsion (ME) is prepared by mixing 720 grams of deionized water, 6.5 grams of sodium dodecylbenzenesulfonate (SDS, 23%) (an anionic emulsifier), 10.0 grams of methacrylic acid, and 780.0 grams of methyl methacrylate. From this ME, 164 grams are removed and set aside. To the remaining ME is added 71.2 grams of SDS (23%) and 510 grams of methacrylic acid. With the kettle water at 86° C., a mixture of 160 grams of deionized water, 10.4 grams of SDS (23%), and 20.5 grams of Plurafac® B-25-5 (Plurafac is a trademark of BASF), followed by the ME removed from the initial ME, followed by a mixture of 5.5 grams of sodium persulfate in 40 grams of deionized water are added to the kettle. The contents of the kettle are stirred for 15 minutes. The remaining ME is then fed to the kettle over a two hour period at 85° C. After the completion of the monomer feed the dispersion is held at 85° C. for 15 minutes, cooled to 25° C. and filtered to remove any coagulum. The filtered dispersion had a pH of 3.0, 30.3% solids content and an average particle size of 145 nm.

A 5-liter, four necked round bottom flask is equipped with paddle stirrer thermometer, nitrogen inlet, and reflux condenser. Deionized water, 1700 grams, is added to the kettle and heated to 86° C. under a nitrogen atmosphere. To the heated kettle water is added 3.8 grams of sodium persulfate dissolved in 30 grams of deionized water. This is immediately followed by 190.5 grams of the core prepared as described above. A monomer emulsion (ME I) which is prepared by mixing 50 grams of deionized water, 3.0 grams of SDS (23%), 10.8 grams of butyl methacrylate, 106.8 grams of methyl methacrylate, and 2.4 grams of methacrylic acid is added to the kettle at a rate of 4.5 grams/minute at a temperature of 80° C. Upon completion of ME I, a second monomer emulsion (ME II) is prepared by mixing 190 grams of deionized water, 3.8 grams of SDS (23%), and 720 grams of styrene. From this ME II, 137 grams are removed and set aside. The initial portion of ME II is added to the kettle at a rate of 25 grams/minute and a mixture of 1.9 grams of sodium persulfate dissolved in 75 grams of deionized water is co-fed to the reactor at a rate of 2.5 grams/minute. The temperature of the reaction mixture is allowed to increase to 92° C. Upon completion of the ME II and co-feeds a mixture of 8 grams of 4-hydroxy TEMPO (a polymerization inhibitor) and 8 grams of deionized water are added to the kettle and the batch cooled to 85° C. When the reaction mixture reaches 85° C., the held back portion of ME II (137 grams) is added to the reactor followed by the addition of 42 grams of ammonium hydroxide. The reaction mixture is held 5 minutes at 85° C. After the 5 minute hold a mixture of 0.95 grams of sodium persulfate dissolved in 20 grams of deionized water is added to the kettle. The reaction mixture is held for 30 minutes at 85° C. and then cooled to room temperature and filtered to remove any coagulum formed. The final latex has a solids content of 27.5%, a pH of 10.0, and a particle size of 404 nm. An acid titration shows good core encapsulation with only 4.0% core acid titratable. The dry density of this polymer is determined to be 0.6189 g/cc.

Example 2

Opacity Performance

In this example, the opacity performance of two opacifiers is studied. The materials of this example are as follows:

- Opacifier 1 is a comparative, commercially available, opacifier composed of a styrene/acrylates copolymer emulsion that is 40% solids in water.
- Opacifier 2 is an inventive opacifier prepared substantially as described in Example 1, and used as a dispersion containing 30% solids in water. The Opacifier 2 has a void fraction of about 35 to 45%.
- Solvents tested: propylene glycol, dipropylene glycol and polyethylene glycol 400.

Procedure. Initially, 30 g of each solvent are weighed into a plastic beaker. Then, 0.2 g of each opacifier are added to the solvent under 400 rpm agitation using a mechanical agitator. Agitation is stopped when the opacifier is visually well dispersed which corresponds to approximately 2 minutes of stirring. The opacified solvents are then poured into Turbiscan® vials, and light backscattering measured using a Turbiscan Labexpert apparatus from Formulaction Company. Results are measured at 23° C. The data is shown in Table 2.

TABLE 2

| Opacifier | Solvent | backscattering in %-after 24 H |
|---|---|---|
| Opacifier 1 | Dipropylene Glycol | 18% |
| Opacifier 2 | Dipropylene Glycol | 45% |
| Opacifier 1 | Propylene glycol | 20% |
| Opacifier 2 | Propylene glycol | 41% |
| Opacifier 1 | Polyethylene glycol 400 | 16% |
| Opacifier 2 | Polyethylene glycol 400 | 45% |

The higher the backscattering (BS), the higher is the opacity. As demonstrated by the data, inventive Opacifier 2 provides a higher opacity performance than the comparative Opacifier 1 when added at the same weight level, i.e., 0.2 g opacifier in 30 g of the three different solvents. Moreover, considering the percent solids of the two opacifiers, the data further demonstrates that inventive Opacifier 2, a 30% solids in water emulsion, provides a higher opacity performance in the three solvents at a lower dosage than comparative Opacifier 1, a 40% solids emulsion in water. Thus, opacifiers of the invention increase opacity performance while decreasing the required dosage.

Example 3

Opacity Performance/Reduced Water

There is a trend in the detergents industry for concentrated liquid detergent containing less and less water. Hence, in many applications, it is desirable for the water content of each ingredient to be as low as possible.

This example compares the opacity performance of the two opacifiers described above: comparative Opacifier 1 and inventive Opacifier 2, both in dipropylene glycol. The opacity response as a function of the water introduced by each opacifier in dipropylene glycol is studied. Materials are as follows:

Opacifier 1 (comparative) is made of 60% w/w water and 40% w/w solids (per Example 2).

Opacifier 2 (inventive) is made of 70% w/w water and 30% w/w solids (per Example 2).

A stock solution containing 0.77% w/w Opacifier 1 is prepared. As this opacifier is 40% solids, it contributes 0.46% water. A stock solution containing 0.66% w/w Opacifier 2 is prepared. As this opacifier is 30% solids, it also contributes 0.46% water. The stock solutions are diluted by factors of 2, 4 and 8 with dipropylene glycol. Then the opacified solvents are distributed into Turbiscan® vials, to measure the light backscattering (BS) and the transmission (T) measurements, using a Turbiscan Labexpert apparatus. The higher the backscattering (BS), the higher is the opacity. The higher the transmission (T) the higher is the transparency. Backscattering results are shown in Table 3. Transmission results are shown in Table 4.

TABLE 3

| Backscattering Measurements | | |
|---|---|---|
| % water[1] | % BS Opacifier 1 | % BS Opacifier 2 |
| 0.46 | 18.9 | 40 |
| 0.23 | 14.0 | 29 |

TABLE 3-continued

| Backscattering Measurements | | |
|---|---|---|
| % water[1] | % BS Opacifier 1 | % BS Opacifier 2 |
| 0.12 | 11.5 | 22 |
| 0.06 | 11.0 | 16 |

[1]percent of water contributed by the opacifier

The data in Table 3 shows that when the amount of water contributed by the opacifiers is the same between the inventive and comparative opacifiers, the inventive opacifier provides a higher opacity than the comparative. This permits use of less opacifier and therefore introduction of less water. For instance, for an approximately 20% backscattering opacity, comparative Opacifier 1 contributes 0.46% water whereas inventive Opacifier 2 contributes only 0.12% water. Thus the water level is reduced by a factor of 3.8 by using the inventive opacifier.

TABLE 4

| Transmission Measurements | | |
|---|---|---|
| % water | % T Opacifier 1 | % T Opacifier 2 |
| 0.46 | 3.0 | 0 |
| 0.23 | 16.0 | 0 |
| 0.12 | 38.0 | 0.01 |
| 0.06 | 62.0 | 5 |

The transmission data in Table 4 shows that inventive Opacifier 2 has a low and rather constant transmission percentage, below 1%, meaning that each formulation is essentially "non-transparent" whatever the amount of water introduced by the opacifier. In contrast, comparative Opacifier 1 has a transmission percentage which increases in an exponential way when the amount of water introduced by the opacifier decreases (linked to the decrease of opacifier dosage). The formulations become translucent from 0.12% water brought by the Opacifier 1.

Even when the inventive opacifier brings only 0.06% water, corresponding to 0.086% weight opacifier, the inventive opacifier still provides excellent opacity. At the same level of water, the comparative opacifier is no longer opaque but is translucent instead.

In summary, inventive opacifiers provide excellent opacity while introducing a minimum of water, allowing a reduction of water brought to a formulation.

What is claimed is:

1. A detergent composition comprising: an opacifier, a surfactant, a solvent, and optionally a builder, wherein the opacifier is an aqueous dispersion of voided latex particles comprising:

(i) at least one core polymer comprising polymerized units derived from (a) 5 to 100 percent by weight, based on the weight of the core polymer, of at least one hydrophilic monoethylenically unsaturated monomer selected from the group consisting of acrylic acid, methacrylic acid, acryloxypropionic acid, (meth)acryloxypropionic acid, itaconic acid, aconitic acid, maleic acid or anhydride, fumaric acid, crotonic acid, monomethyl maleate, monomethyl fumarate, monomethyl itaconate and mixtures thereof, and (b) from 0 to 95 percent by weight, based on the weight of the core polymer, of at least one nonionic monoethylenically unsaturated monomer selected from the group consisting of vinyl toluene, ethylene, vinyl acetate, vinyl chloride, vinylidene chloride, (meth) acrylonitrile, (meth)acrylamide, $C_{1-20}$ alkyl or $C_{3-20}$ alkenyl esters of (meth)acrylic acid and mixtures thereof; and (ii) at least one shell polymer comprising polymerized units derived from at least 50 percent by weight, based on the total weight of the shell polymer, of at least one nonionic monoethylenically unsaturated monomer selected from the group consisting of styrene, α-methyl styrene, p-methyl styrene, t-butyl styrene, vinyl toluene, ethylene, vinyl acetate, vinyl chloride, vinylidene chloride, (meth)acrylonitrile, (meth)acrylamide and $C_{1-20}$ alkyl or $C_{3-20}$ alkenyl esters of (meth)acrylic acid, wherein the voided latex particles contain a void with a void fraction of 25 to 50%; and wherein the voided latex particles have a particle size of from 50 nm to 1000 nm.

2. The detergent composition of claim 1, wherein the hydrophilic monoethylenically unsaturated monomer of the at least one core polymer is selected from the group consisting of acrylic acid, methacrylic acid and mixtures thereof, and the nonionic monoethylenically unsaturated monomer of the at least one core polymer is selected from the group consisting of methyl (meth)acrylate, ethyl (meth)acrylate, butyl (meth)acrylate, 2-ethylhexyl (meth)acrylate, hydroxyethyl (meth)acrylate, hydroxypropyl (meth) acrylate, benzyl (meth)acrylate, lauryl (meth)acrylate, oleyl (meth)acrylate, palmityl (meth)acrylate, stearyl (meth)acrylate and mixtures thereof.

3. The detergent composition of claim 1, wherein the voided latex particles further comprise an intermediate stage polymer.

4. The detergent composition of claim 3, wherein the intermediate stage polymer comprises, as polymerized units, (a) from 0.3 to 20 percent by weight, based on the weight of the intermediate stage polymer, of at least one hydrophilic monoethylenically unsaturated monomer selected from the group consisting of acrylic acid, methacrylic acid, acryloxypropionic acid, (meth)acryloxypropionic acid, itaconic acid, aconitic acid, maleic acid or anhydride, fumaric acid, crotonic acid, monomethyl maleate, monomethyl fumarate, monomethyl itaconate and mixtures thereof, and (b) from 80 to 99.7 percent by weight, based on the weight of the intermediate stage polymer, of at least one nonionic monoethylenically unsaturated monomer selected from the group consisting of vinyl toluene, ethylene, vinyl acetate, vinyl chloride, vinylidene chloride, (meth)acrylonitrile, (meth) acrylamide and $C_{1-20}$ alkyl or $C_{3-20}$ alkenyl esters of (meth) acrylic acid.

5. The detergent composition of claim 1 wherein the voided latex particles are present in an amount of 0.02 to 1.5 wt % solids based on the total weight of the detergent composition.

6. The detergent composition of claim 1, wherein the detergent composition is a unit dose laundry or unit dose dishwashing detergent, wherein the detergent composition comprises no more than 25 wt % water based on the total weight of the detergent composition and wherein the detergent composition is encased in a water soluble pouch or film.

7. The detergent composition of claim 1 that is an aqueous dishwashing or laundry detergent.

8. A detergent packet comprising the detergent composition of claim 1 encased in a water soluble pouch or film.

9. A method for providing opacity to a detergent composition containing a surfactant, a solvent, and optionally a builder, the method comprising including in the detergent composition an opacifier, wherein the opacifier is an aqueous dispersion of voided latex particles comprising:

(i) at least one core polymer comprising polymerized units derived from (a) 5 to 100 percent by weight, based on the weight of the core polymer, of at least one hydrophilic monoethylenically unsaturated monomer selected from the group consisting of acrylic acid, methacrylic acid, acryloxypropionic acid, (meth)acryloxypropionic acid, itaconic acid, aconitic acid, maleic acid or anhydride, fumaric acid, crotonic acid, monomethyl maleate, monomethyl fumarate, monomethyl itaconate and mixtures thereof, and (b) from 0 to 95 percent by weight, based on the weight of the core polymer, of at least one nonionic monoethylenically unsaturated monomer selected from the group consisting of vinyl toluene, ethylene, vinyl acetate, vinyl chloride, vinylidene chloride, (meth) acrylonitrile, (meth)acrylamide, $C_{1-20}$ alkyl or $C_{3-20}$ alkenyl esters of (meth)acrylic acid and mixtures thereof; and (ii) at least one shell polymer comprising polymerized units derived from at least 50 percent by weight, based on the total weight of the shell polymer, of at least one nonionic monoethylenically unsaturated monomer selected from the group consisting of styrene, α-methyl styrene, p-methyl styrene, t-butyl styrene, vinyl toluene, ethylene, vinyl acetate, vinyl chloride, vinylidene chloride, (meth)acrylonitrile, (meth)acrylamide and $C_{1-20}$ alkyl or $C_{3-20}$ alkenyl esters of (meth)acrylic acid, wherein the voided latex particles contain a void with a void fraction of 25 to 50%; and wherein the voided latex particles have a particle size of from 50 nm to 1000 nm.

* * * * *